US009574726B2

(12) United States Patent
Cselenyi et al.

(10) Patent No.: US 9,574,726 B2
(45) Date of Patent: Feb. 21, 2017

(54) LED ILLUMINATED DECORATIVE MESH ASSEMBLY

(71) Applicant: GROUPE ERA INC., Saint-Laurent, Québec (CA)

(72) Inventors: Suzanne Cselenyi, Dollard des Ormeaux (CA); Marc Tremblay, Ile Bizard (CA)

(73) Assignee: GROUPE ERA INC., Saint-Laurent, Quebec (CA)

( * ) Notice: Subject to any disclaimer, the term of this patent is extended or adjusted under 35 U.S.C. 154(b) by 73 days.

(21) Appl. No.: 14/418,452

(22) PCT Filed: Mar. 8, 2013

(86) PCT No.: PCT/CA2013/000210
§ 371 (c)(1),
(2) Date: Jan. 30, 2015

(87) PCT Pub. No.: WO2014/036629
PCT Pub. Date: Mar. 13, 2014

(65) Prior Publication Data

US 2015/0204496 A1 Jul. 23, 2015

Related U.S. Application Data

(60) Provisional application No. 61/698,136, filed on Sep. 7, 2012.

(51) Int. Cl.
*F21V 21/00* (2006.01)
*F21S 4/00* (2016.01)
(Continued)

(52) U.S. Cl.
CPC ..... *F21S 4/002* (2013.01); *D03D 15/0033* (2013.01); *F21L 4/02* (2013.01); *F21S 4/15* (2016.01);
(Continued)

(58) Field of Classification Search
CPC ..... D03D 15/00; D03D 15/0033; D10B 2401/20; F21L 4/02; F21S 4/15; F21S 4/22; F21S 9/02; F21V 33/0008; F21Y 2101/02
See application file for complete search history.

(56) References Cited

U.S. PATENT DOCUMENTS 3,500,033 A 3/1970 Cole, Jr. et al.
5,888,090 A * 3/1999 Achee ..... H01R 25/142 439/417
(Continued)

FOREIGN PATENT DOCUMENTS

CN 2413152 Y 1/2001
CN 201032092 Y 3/2008
(Continued)

*Primary Examiner* — Peggy Neils
(74) *Attorney, Agent, or Firm* — Fraser Clemens Martin & Miller LLC; James D. Miller

(57) ABSTRACT

A mesh assembly having a flexible mesh sheet, said sheet defining two opposite main faces, at least one elongated sock extending along said mesh and each sock defining a tubular hollow, each of said at least one sock is loosely connected to said mesh sheet at selected intervals by attachment means; a number of light emitting means are mounted into each sock hollow at selected intervals along the length thereof, and light reflecting means being provided on at least one of said two main faces of said mesh sheet, wherein said mesh assembly generate decorative visual effects upon said light emitting means being activated.

18 Claims, 5 Drawing Sheets

(51) Int. Cl.

| | |
|---|---|
| ***F21L 4/02*** | (2006.01) |
| ***F21V 33/00*** | (2006.01) |
| ***D03D 15/00*** | (2006.01) |
| ***F21S 9/02*** | (2006.01) |
| *A44C 15/00* | (2006.01) |

(52) U.S. Cl.
CPC .. *F21S 4/22* (2016.01); *F21S 9/02* (2013.01); *F21V 33/0008* (2013.01); *A44C 15/0015* (2013.01); *D10B 2401/20* (2013.01); *F21Y 2105/10* (2016.08); *F21Y 2115/10* (2016.08)

(56) References Cited

U.S. PATENT DOCUMENTS

| | | | | |
|---|---|---|---|---|
| 9,314,002 | B2 * | 4/2016 | Franey | A01K 27/006 |
| 2003/0043579 | A1 | 3/2003 | Rong et al. | |
| 2006/0256546 | A1 * | 11/2006 | Amaral | A45C 7/0063 362/103 |
| 2007/0171644 | A1 | 7/2007 | Seibel | |
| 2008/0038506 | A1 * | 2/2008 | Schumacher | D03D 15/02 428/72 |
| 2009/0021939 | A1 * | 1/2009 | Costello | D03D 9/00 362/249.02 |
| 2010/0001664 | A1 * | 1/2010 | Shih | F21S 4/20 315/313 |
| 2010/0117537 | A1 * | 5/2010 | Horppu | D04B 1/16 315/76 |
| 2012/0155065 | A1 * | 6/2012 | Ubaghs | F21V 33/0008 362/103 |
| 2012/0170232 | A1 * | 7/2012 | Bhattacharya | D03D 3/005 361/749 |

FOREIGN PATENT DOCUMENTS

| | | | |
|---|---|---|---|
| CN | 201047518 | Y | 4/2008 |
| CN | 101455461 | A | 6/2009 |
| CN | 201318582 | Y | 9/2009 |
| CN | 201364713 | Y | 12/2009 |
| CN | 201502915 | U | 6/2010 |
| CN | 102003651 | A | 4/2011 |
| CN | 102095118 | A | 6/2011 |
| CN | 102192429 | A | 9/2011 |
| CN | 102192430 | A | 9/2011 |
| DE | 20 2011 000 274 | U1 | 5/2011 |
| WO | 2009058723 | A2 | 5/2009 |

* cited by examiner

LED ILLUMINATED DECORATIVE MESH ASSEMBLY

CROSS-REFERENCE DATA

This application claims the conventional priority of U.S. Provisional patent application No. 61/698,136 filed on Sep. 7, 2012.

FIELD OF THE INVENTION

The invention relates to illuminated flexible mesh assemblies provided for decorative purposes.

BACKGROUND OF THE INVENTION

There is always a demand for products associated with festivities, parties, and other non-work activities for relaxing and enjoying after a week or other period of hard work or studies. Historically, at least some of these festivities included a religious faith component or justification or were charged with some other spiritual values. However, with globalization of commerce and free circulation and immigration of populations with intermixing of different religious faiths such as for example Christian, Jewish and Muslim faiths, not to mention employees who are agnostic, it has become increasingly awkward to accommodate everyone. This has led to increased secularism in services provided by government and private employers alike. Accordingly, there is a need to provide festivity paraphernalia that are secular i.e. neutral from the religious or spiritual point of view.

Chinese utility model publication No. CN2413152Y published 3 Jan. 2001 in the name of Zhong Xiyao, discloses a lamp decoration main body and a net body. A string of light emitting diodes (LEDs) are arranged to display the state of patterns, and are fixed on the net body. An electric wire interconnects the LEDs to a power source, and to an electric control box. These illuminated patterns display dynamic effects through a circuit. The net body is formed by braiding a plurality of flexible wire bodies. The net body can be folded or rolled up to a minimal volume to save space for storage.

Chinese utility model publication No. CN201364713Y published 16 Dec. 2009 to Shide Peng, discloses a silk net decorative display screen, having a multiple LEDs display module strips which are in parallel with each other and arrayed in a same space. The display screen also includes at least two braided wires for assembling the multiple LEDs display module strips to a hanging curtain. Punch holes are set on the braided wires, wherein the multiple LEDs display modules are set in the punch holes on the screen with a same space. The display screen can curve flexibly, be tucked and move freely like curtains. Wires reflect light source to keep the display screen reflective under the reflection of light, thus providing decoration.

Weaving is a method of fabric or synthetic fiber production in which two distinct sets of yarns or threads are interlaced at right angles to form a fabric, cloth, or fiber mesh. Alternate known methods of fabric manufacture include knitting, lace making, felting and braiding or plaiting. The longitudinal threads or yarns are called the warp and the lateral threads are the weft (''that which is woven) or filling. Therefore, the weft is the term for the yarn which is drawn through the warp yarns to create cloth or other fiber sheet. Warp is the lengthwise or longitudinal thread in a roll, while weft is the transverse thread.

Clearly, the method in which these threads are inter woven affects the characteristics of the cloth or mesh sheet. Cloth is usually woven on a loom, a device that holds the warp threads in place while filling threads are woven through them. A fabric band or synthetic fiber mesh which meets this definition of cloth (warp threads with a weft thread winding between) can also be made using other methods, including tablet weaving, back-strap, or using a shuttle, air jets or rapier grippers, or other techniques without looms. The way the warp and filling threads interlace with each other is called the weave. The majority of woven products are created with one of three basic weaves: plain weave, sating weave or twill. Woven cloth or fiber mesh can be plain (in one colour or a simple pattern), or can be woven in decorative or artistic designs.

SUMMARY OF THE INVENTION

The invention consists of a mesh assembly having an elongated flexible planar mesh sheet made of yarns, said sheet defining two opposite main faces, at least one elongated translucent sock (and for example two socks or three socks) extending along said mesh sheet and each sock defining a tubular hollow, each of said at least one sock is connected to said mesh sheet; a number of light emitting means are mounted into each sock hollow at selected intervals along the length thereof, and light reflecting means being provided on at least one of said two main faces of said mesh sheet, wherein said mesh assembly generates decorative visual effects upon said light emitting means being activated.

In one embodiment, each sock is connected to said mesh sheet by attachment means comprising a number of stitching lines loosely connecting said at least one sock at selected intervals to a few of said mesh sheet yarns.

In one embodiment, each sock has a semi-flexible memory shape construction, wherein compressive transverse pressure will collapse the sock but release of this compression pressure will allow the sock to automatically spring back to its original tubular shape. Each sock may extend spacedly from the plane of said mesh sheet and generally parallel thereto. In one embodiment, said light emitting means consists of light emitting diodes (LEDs), said LEDs powered by power means. These power means could include an elongated flexible electrical wiring with double or triple copper threads and with common insulating sheath , running through the hollow of each of said at least one sock, and operatively connected to the electrical wiring threads of a corresponding elongated other electrical wiring having opposite one and another ends, with said one end of the other electrical wiring operatively connected to a power source. This power source could be a portable battery power pack having an operative control knob.

In one embodiment, said mesh sheet is also translucent.

In one embodiment, said mesh sheet is made from a material selected from the group comprising polypropylene, polyester and PVC plastic.

In one embodiment, said mesh sheet is made from weaved fibers defining weft yarns and warp yarns with the weft yarns drawn through the warp yarns to create the weaved fiber mesh sheet.

Said light reflecting means could also consist of integral light reflecting bands, for decorative effect. The light reflecting bands could be of a variety of different colors.

In an alternate embodiment of the invention, each sock is connected to said mesh sheet by having each sock extending generally parallel to and located in between two corresponding successive warp yarns, wherein weft yarns are drawn through the warp yarns and associated warp sock to create the weaved fiber mesh sheet, so that each sock forms a warp sock that undulates through the mesh sheet by moving up and down like waves through the weaved fiber mesh sheet.

DETAILED DESCRIPTION OF THE PREFERRED EMBODIMENT OF THE INVENTION

Figure 1:
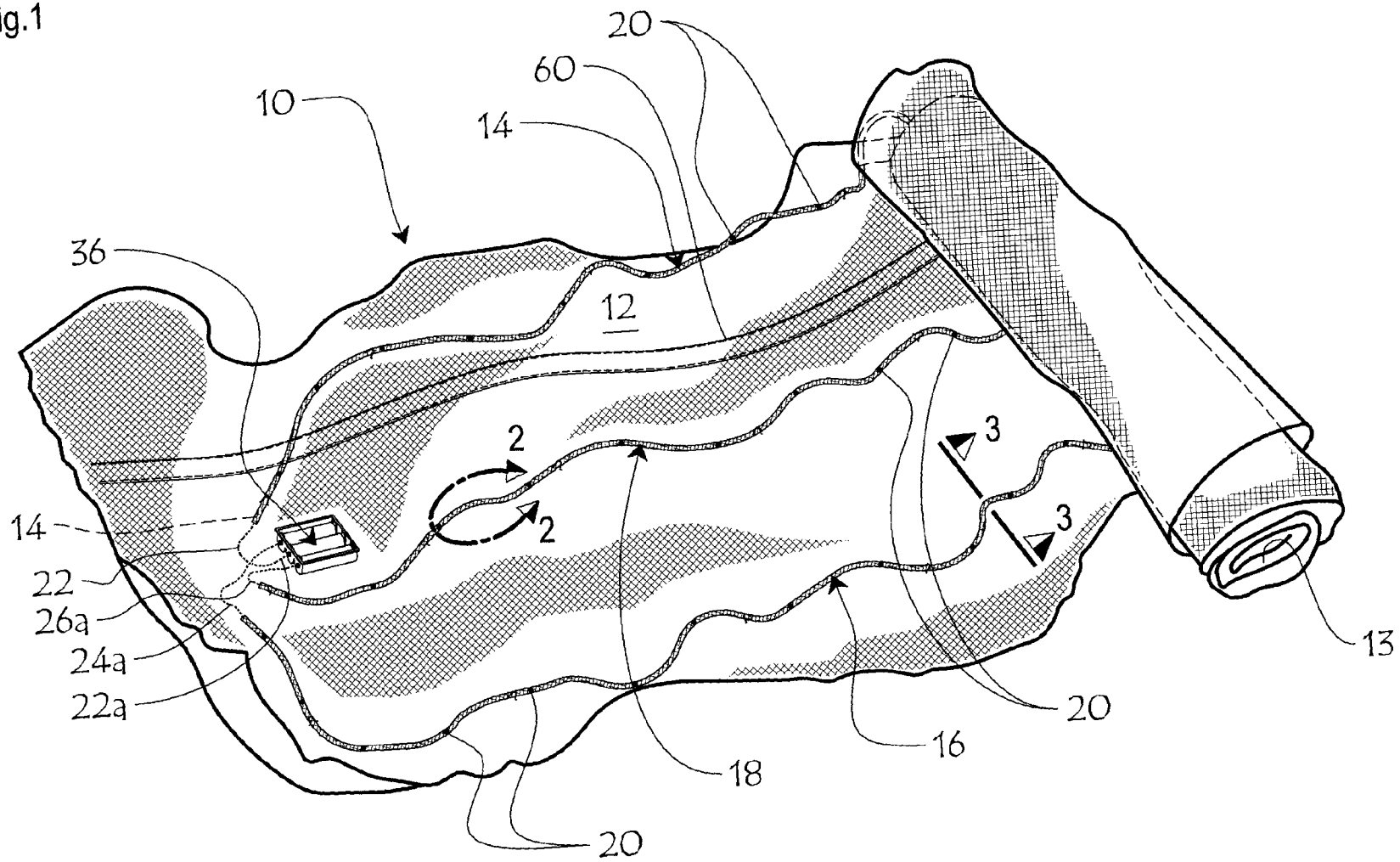
FIG. 1 is a perspective view of a first embodiment of partly deployed mesh sheet roll, showing the LED wires array and associated battery power pack.

As illustrated in the embodiment of FIG. 1, the mesh assembly 10 may include an elongated flexible planar mesh sheet 12, made for example from polypropylene, polyester or PVC plastic. Mesh 12 is for example rectangular, preferably made from weaved fibers, and can be rolled around a cardboard tube 13. At least one tubular elongated flexible sock 14, and for example three tubular elongated socks 14, 16, 18, respectively, as shown, are provided , extending along the rectangular mesh 12, for example one along each opposite longitudinal edge portions thereof and one along the central longitudinal portion thereof. Each sock 14, 16, 18, is for example made from the same material as the mesh, preferably polypropylene. In this embodiment, each sock 14, 16, 18, extends spacedly over the plane of mesh sheet 12.

In one embodiment, each sock 14, 16, 18, has a semi-flexible memory shape construction, wherein compressive transverse pressure will collapse the sock but release of this compressive pressure will allow the sock to automatically spring back and return to its original tubular shape. In one embodiment, each sock 14, 16, 18, is tubular, and loosely connected to the rectangular mesh sheet 12 spacedly from the plane thereof at selected intervals, for example at 20 cm lengthwise intervals, for example by manually stitching same at stitch lines 20 to one or a few yarns from the weaved fiber mesh sheet.

Figure 2:
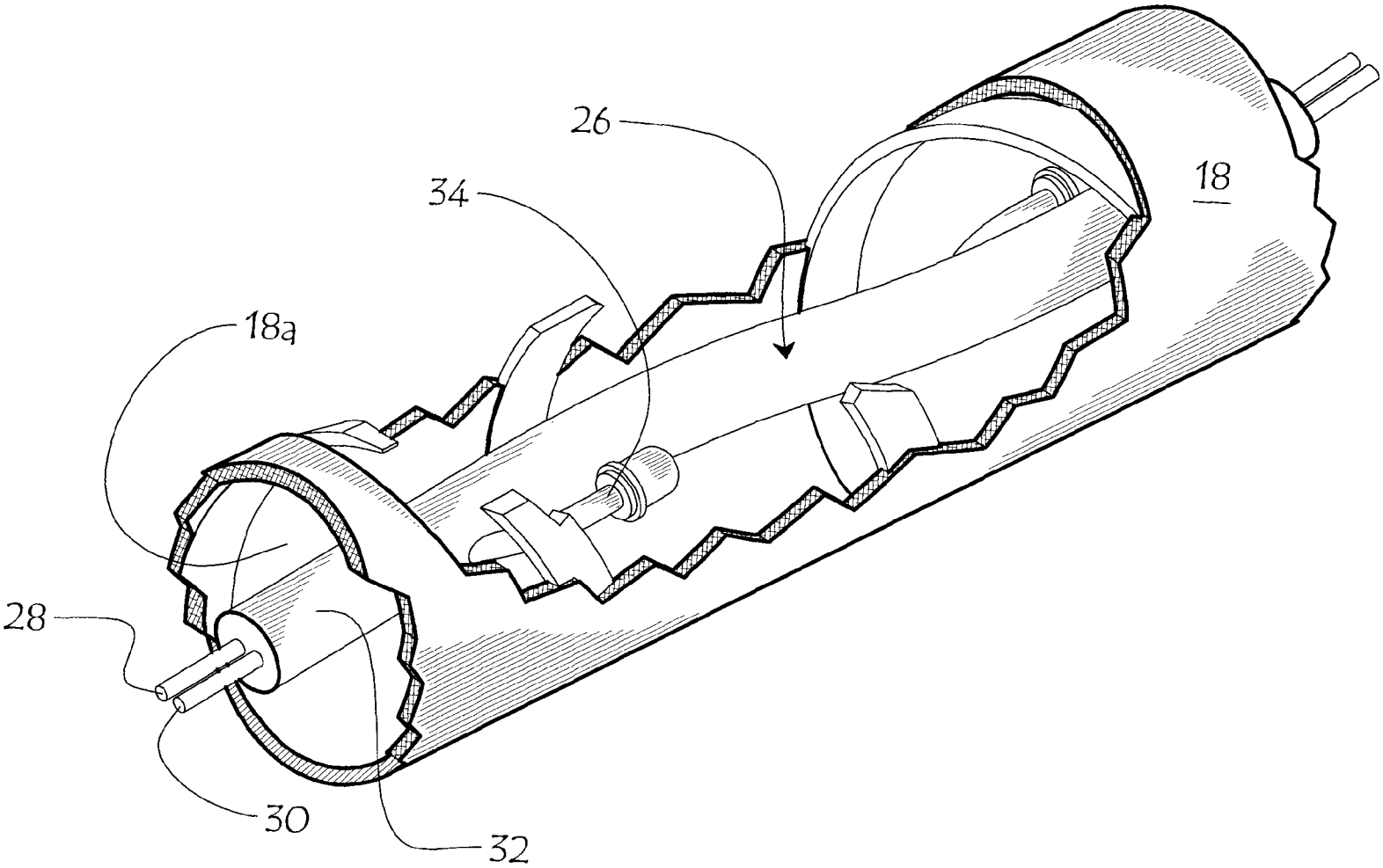
FIG. 2 is an enlarged partly broken view of the area circumscribed within ellipse 2-2 of FIG. 1.
Figure 3:
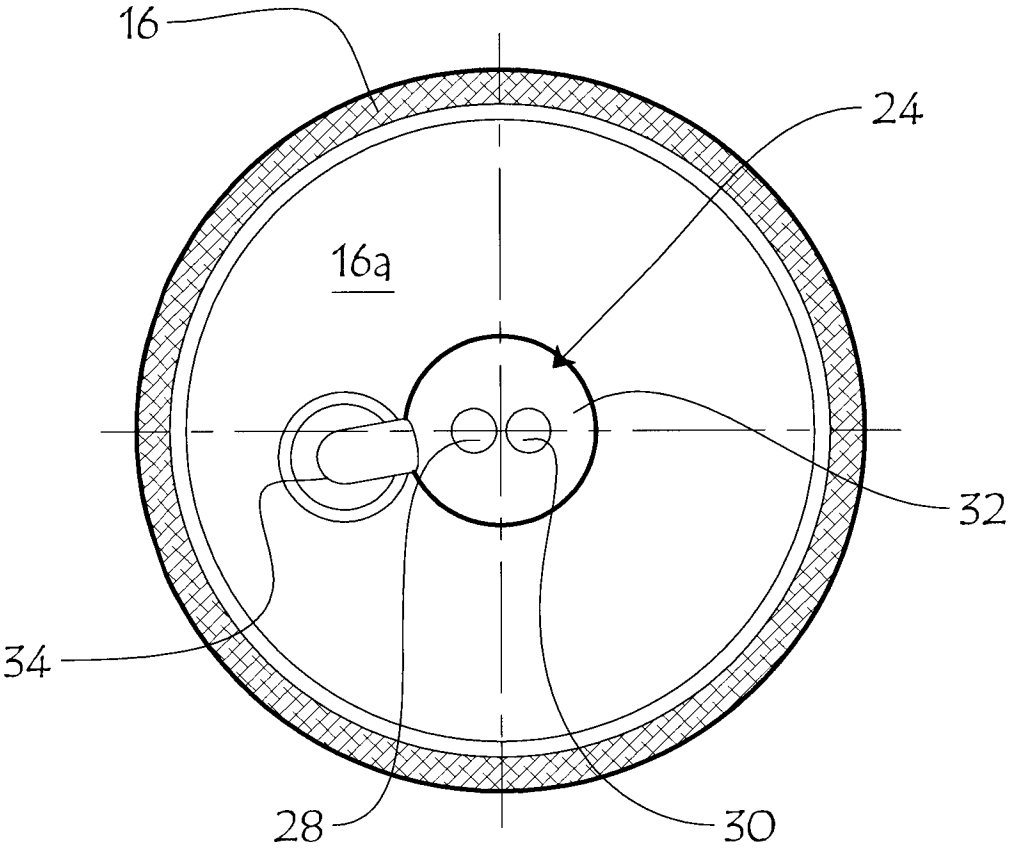
FIG. 3 is an enlarged cross-sectional view taken along line 3-3 of FIG. 1.

As seen in FIGS. 1-3, in one embodiment, an elongated flexible electrical wiring 22, 24, 26, each e.g. with double copper threads 28, 30, and with common insulating sheath 32, runs through the hollow 14A, 16A, 18A, of each tubular sock 14, 16, 18, respectively. LED diodes 34 are mounted into the sock hollows 14A, 16A, 18A at selected spaced intervals along the length thereof, for example at 4, 6, 8 or 10 cm lengthwisely spaced intervals, and operatively connected to the electrical wiring threads 28, 30 of corresponding electrical wiring 22, 24, 26. The outer ends 22A, 24A, 26A, of all electrical wirings 22, 24, 26, may be operatively connected to a battery power pack 36, having for example two AA batteries, or to an adaptor connected to wall plug.

It is noted that such hollow socks 14, 16, 18, provide unexpected results when made from a translucent material, in that they allow light to pass outwardly through the tubular socks, with stunning visual light effects, and also allow memory based collapse under transverse biasing pressure that will return to its original tubular shape once the biasing pressure has been released.

Figure 4:
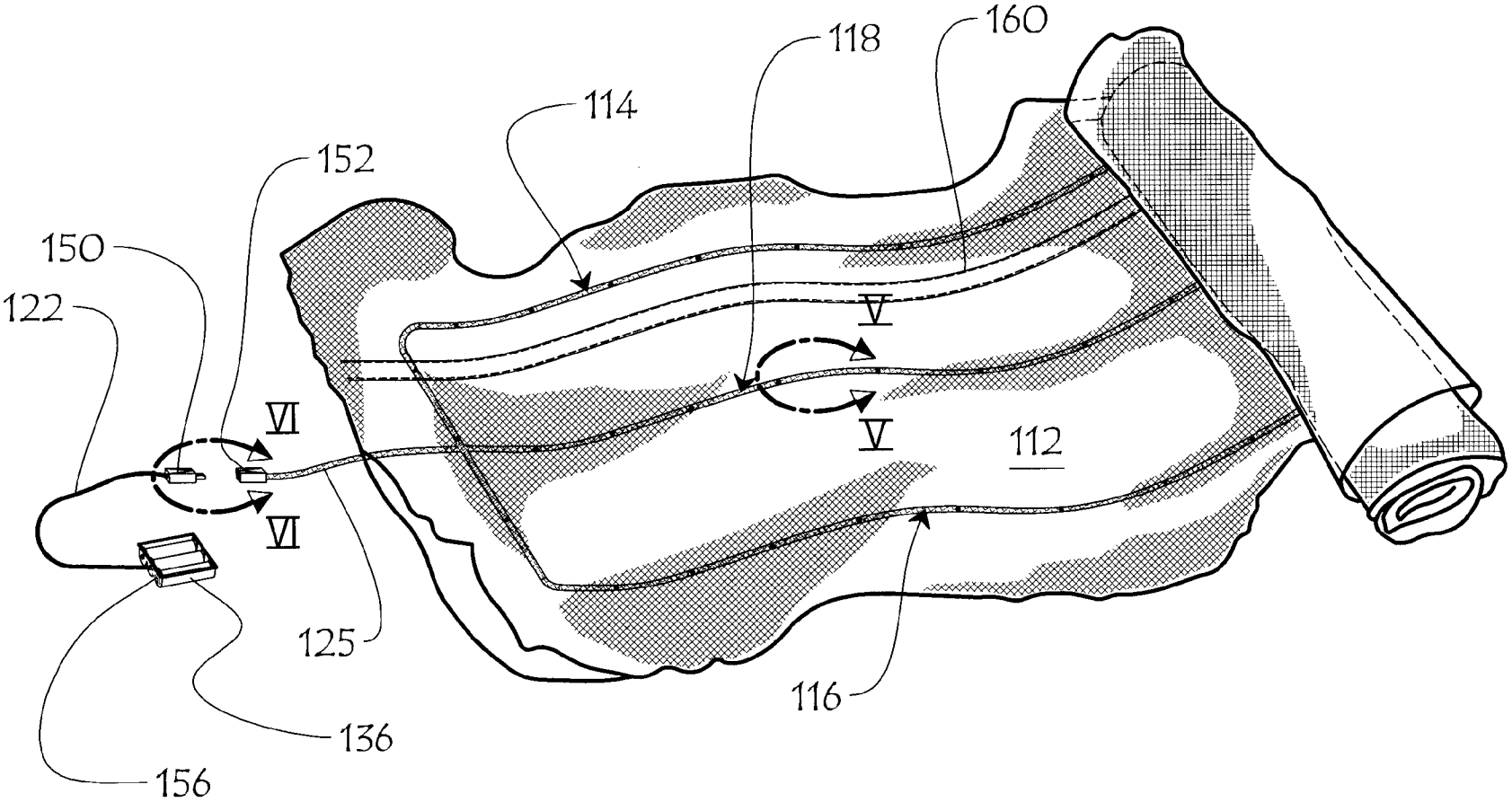
FIG. 4 is a view similar to FIG. 1, but showing a second embodiment of the invention.
Figure 5:
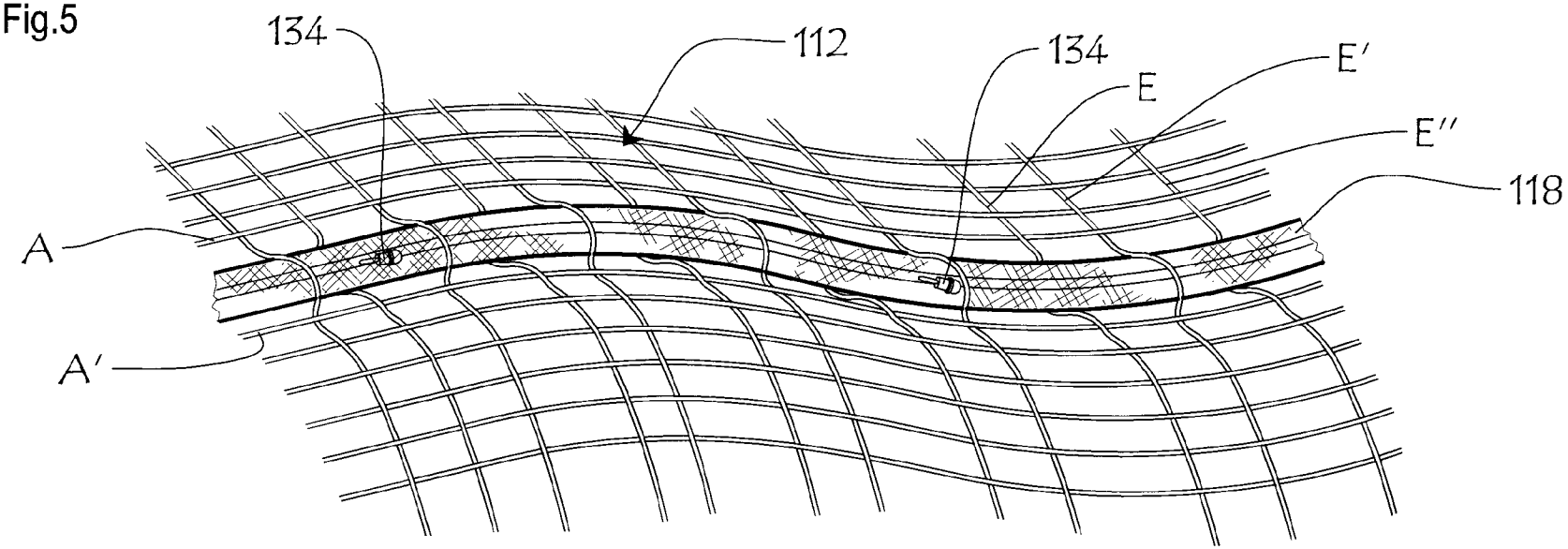
FIGS. 5 and 6 are enlarged views taken within the areas circumscribed by arrows 5 and 6 respectively of FIG. 4.
Figure 6:
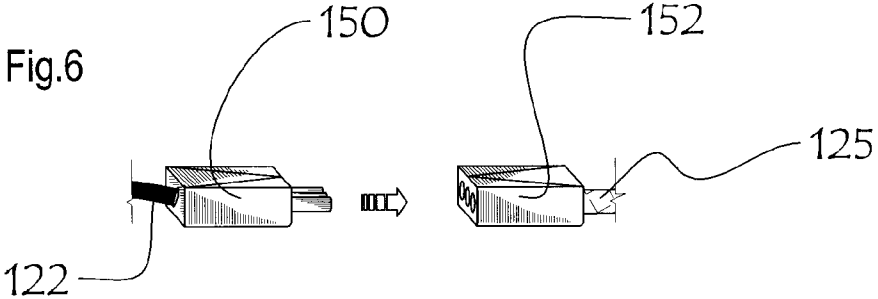

In an alternate embodiment shown in FIGS. 4-6 of the drawings, there is provided at least one elongated sock 114, not excluding a second sock 116, and a third sock 118, similar to socks 14, 16, 18, with each sock 114, 116, 118 having electric wires and LED diodes as with socks 14-18. However, instead of securing the socks 114, 116, 118, . . . by stitch lines to the yarns of sheet 112, each sock 114, 116, 118, is made integral and generally coplanar to the sheet by forming "warp socks". That is to say, each warp sock (e.g. 118) extends generally parallel to and located in between two successive warp yarns A, A', wherein weft yarns E, E', E", . . . are drawn through the warp yarns and associated warp sock 118 to create the weaved fiber mesh sheet 112. A second sock 116 is similarly made to extend generally parallel to and located in between two other successive warp yarns, spacedly from sock 118, wherein weft yarns are drawn through the warp yarns and associated second sock 116 to create the weaved fiber mesh sheet 112. And so on with sock 114 and other socks if desired. In this way, socks 114, 116, 118, . . . undulate through the weaved fiber mesh sheet, i.e. moves up and down like waves through the weaved fiber mesh sheet.

In one embodiment, a single electric wire 122 projects at one end from battery power pack 136, and comprise a male-female adaptor 150 at the end opposite said one end thereof. Another electric wire 125 is also provided, having at one end thereof a male-female adaptor 152 complementary to and releasably engageable by the first adaptor 150, and having the end thereof opposite said one end thereof being operatively interconnected to said electric wires that extend lengthwisely through socks 114, 116, 118, . . . A control knob 156 on power pack 136 may be provided, to enable selection of various types of dynamic lighting patterns for LED diodes 34, 134, for example, constant, blinking, time-lapse, etc.

One or both of the two opposite main faces of the mesh sheet 12, 112, may carry integral light reflecting bands 60, 160, of varying colors, for improved decorative effect, for example: red, with red gold threads; white, with gold threads; white, with silver threads; and green, with green gold threads. Also, two or more mesh sheets 12, 12, or 112, 112, can be edgewisely interconnected to form an extended elongated mesh assembly.

We claim:

1. A mesh assembly having an elongated flexible planar mesh sheet made of yarns, said sheet defining two opposite main faces, at least one elongated translucent sock extending along said mesh sheet and each sock defining a tubular hollow, each of said at least one sock is connected to said mesh sheet; a number of light emitting means are mounted into each sock hollow at selected intervals along the length thereof, and light reflecting means being provided on at least one of said two main faces of said mesh sheet, wherein said mesh assembly generates decorative visual effects upon said light emitting means being activated, wherein each said sock is connected to said mesh sheet by attachment means comprising a number of stitching lines, loosely connecting said at least one sock at selected spaced intervals to a few of said sheet yarns, wherein each sock has a semi-flexible memory shape construction, and wherein compressive transverse pressure will collapse the sock but release of the compressive pressure will allow the sock to spring back and automatically return to its original tubular shape.

2. A mesh assembly as in claim 1,
wherein each sock extends spacedly from the plane of said mesh sheet and generally parallel thereto.

3. A mesh assembly as in claim 2,
wherein said light emitting means consists of light emitting diodes (LEDs), said LEDs powered by power means.

4. A mesh assembly as in claim 3,
wherein said power means includes an elongated flexible electrical wiring with double copper threads and with common insulating sheath, running through the hollow of each of said at least one sock, and operatively connected to the electrical wiring threads of a corresponding elongated other electrical wiring having opposite one and another ends, with said one end of the other electrical wiring operatively connected to a power source.

5. A mesh assembly as in claim 4,
wherein said power source is a portable battery power pack having an operative control knob.

6. A mesh assembly as in claim 1,
wherein said mesh sheet is also translucent.

7. A mesh assembly as in claim 1,
wherein said mesh sheet is made from a material selected from the group comprising polypropylene polyester and plastic.

8. A mesh assembly as in claim 6,
wherein said light emitting means are reflecting bands of a variety of different colors.

9. mesh assembly as in claim 1,
wherein there are three said tubular elongated socks.

10. A mesh assembly as in claim 1,
wherein said mesh sheet is made of weaved fibers defining weft yams and warp yams with the well yarns drawn through the warp yarns to create the sock.

11. A mesh assembly as in claim 10,
wherein said each said sock is connected to said mesh sheet by having each said sock extending generally parallel to and located in between two corresponding successive warp yarns, wherein weft yarns are drawn through the warp yarns and associated warp sock to create the weaved fiber mesh sheet, so that each sock fauns a wrap sock that undulates through the mesh sheet by moving up and down like waves through the weaved fiber mesh sheet.

12. A mesh assembly as in claim 11,
wherein said mesh sheet is translucent.

13. A mesh assembly as in claim 12,
wherein said light emitting means consists of light emitting diodes (LEDs), said LEDs powered by power means.

14. A mesh assembly as in claim 13,
wherein said power means includes an elongated flexible electrical wiring with double copper threads and with common insulating sheath, running through the hollow of each of said at least one sock, and operatively connected to the electrical wiring threads of a corresponding elongated other electrical wiring having opposite one and another ends, with said one end of the other electrical wiring operatively connected to a power source.

15. A mesh assembly as in claim 14,
wherein said power source is a portable battery power pack having an operative control knob.

16. A mesh assembly as in claim 13,
wherein said mesh sheet is made from a material selected from the group comprising polypropylene, polyester and PVC plastic.

17. A mesh assembly as in claim 16,
wherein said light emitting means are reflecting bands of a variety of different colors.

18. A mesh assembly as in claim 12,
wherein there are three said tubular elongated socks.

* * * * *